US005935420A

United States Patent [19]

Baird, Jr. et al.

[11] Patent Number: 5,935,420

[45] **Date of Patent: *Aug. 10, 1999**

[54] DESULFURIZATION PROCESS FOR REFRACTORY ORGANOSULFUR HETEROCYCLES

[75] Inventors: William C. Baird, Jr., Baton Rouge, La.; Gary B. McVicker, Califon, N.J.; James J. Schorfheide; Darryl P. Klein, both of Baton Rouge, La.; Sylvain Hantzer, Prairieville, La.; Michel Daage; Michele S. Touvelle, both of Baton Rouge, La.; Edward S. Ellis, Basking Ridge, N.J.; David E.W. Vaughan, Flemington, N.J.; Jingguang G. Chen, Somerville, N.J.

[73] Assignee: Exxon Research and Engineering Co., Florham Park, N.J.

[ * ] Notice: This patent is subject to a terminal disclaimer.

[21] Appl. No.: 08/918,641

[22] Filed: Aug. 22, 1997

Related U.S. Application Data

[60] Provisional application No. 60/024,737, Aug. 23, 1996.

[51] Int. Cl.[6] ..... C10G 45/00; C10G 25/00

[52] U.S. Cl. ..... 208/213; 208/211; 208/212; 208/217; 208/226

[58] Field of Search ..... 208/211, 212, 208/213, 217, 226

[56] References Cited

U.S. PATENT DOCUMENTS

| | | | |
|---|---|---|---|
| 3,539,306 | 11/1970 | Kumura et al. | 23/315 |
| 3,796,792 | 3/1974 | Miyata et al. | 423/250 |
| 3,879,523 | 4/1975 | Miyata et al. | 423/250 |
| 4,263,020 | 4/1981 | Eberly | 55/62 |
| 4,454,244 | 6/1984 | Woltermann | 502/208 |
| 4,690,806 | 9/1987 | Schorfheide | 423/230 |
| 4,831,206 | 5/1989 | Zarchy | 585/737 |
| 4,831,207 | 5/1989 | O'Keefe et al. | 585/737 |
| 5,057,296 | 10/1991 | Beck | 423/277 |
| 5,185,135 | 2/1993 | Pillai et al. | 423/320 |
| 5,283,047 | 2/1994 | Vaughan et al. | 423/713 |
| 5,366,614 | 11/1994 | Russ et al. | 208/65 |
| 5,439,583 | 8/1995 | Robinson et al. | 208/62 |
| 5,518,607 | 5/1996 | Field et al. | 208/212 |

OTHER PUBLICATIONS

A Review of Deep Hydrodesulfurization Catalysis, Vasudevan et al., Catalysis Reviews—Sci. Eng., 38,(2) (1996) 161–188.

Deep hydrodesulfurization of diesel fuel: Design of reaction process and catalysts, Mochida et al., Catalysis Today 29 (1996), 185–189.

Effect of experimental parameters on the relative reactivity of dibenzothiophene and 4–methyldibenzothiophene, Lamure–Meille et al., Applied Catalysis A: General 131 (1995) 143–157.

Hydrodesulfurization of Methyl–Substituted Dibenzothiophenes Catalyzed by Sulfided Co–Mo / y–AI203, M. Houalla et al., Journal of Catalysis, 61, (1980), 523–527.

Reactivities, Reaction Networks, and Kinetics in High–Pressure Catalytic Hydroprocessing, Girgis and Gates, Ind. Eng. Chem, 30, (1991), 2021–2058.

Hydrotalcite–Type Anionic Clays: Preparation, Properties and Applications, Cavani et al., Catalysis Today, vol. 11, No. 2, (1991), 173–301.

*Primary Examiner*—Walter D. Griffin
*Assistant Examiner*—Tam M. Nguyen
*Attorney, Agent, or Firm*—Henry E. Naylor

[57] ABSTRACT

A process for the hydrodesulfurization (HDS) of multiple condensed ring heterocyclic organosulfur compounds present in petroleum and petrochemical streams over noble metal-containing catalysts under relatively mild conditions. The noble metal is selected from Pt, Pd, Ir, Rh, and polymetallics thereof. The catalyst system also contains a hydrogen sulfide sorbent material.

15 Claims, No Drawings

DESULFURIZATION PROCESS FOR REFRACTORY ORGANOSULFUR HETEROCYCLES

This application claims the benefit of U.S. Provisional Application Ser. No. 60/024,737 Aug. 23, 1996.

FIELD OF THE INVENTION

The present invention relates to a process for the hydrodesulfurization (HDS) of multiple condensed ring heterocyclic organosulfur compounds present in petroleum and petrochemical streams over noble metal-containing catalysts under relatively mild conditions. The noble metal is selected from Pt, Pd, Ir, Rh and polymetallics thereof. The catalyst system also contains a hydrogen sulfide sorbent material.

BACKGROUND OF THE INVENTION

Hydrodesulfurization is one of the fundamental processes of the refining and petrochemical industries. The removal of feed sulfur by conversion to hydrogen sulfide is typically achieved by reaction with hydrogen over non-noble metal sulfides, especially those of Co/Mo and Ni/Mo, at fairly severe temperatures and pressures to meet product quality specifications, or to supply a desulfurized stream to a subsequent sulfur sensitive process. The latter is a particularly important objective because some processes are carried out over catalysts which are extremely sensitive to poisoning by sulfur. This sulfur sensitivity is sometimes sufficiently acute as to require a substantially sulfur free feed. In other cases environmental considerations and mandates drive product quality specifications to very low sulfur levels.

There is a well established hierarchy in the ease of sulfur removal from the various organosulfur compounds common to refinery and petrochemical streams. Simple aliphatic, naphthenic, and aromatic mercaptans, sulfides, di- and polysulfides and the like surrender their sulfur more readily than the class of heterocyclic sulfur compounds comprised of thiophene and its higher homologs and analogs. Within the generic thiophenic class, desulfurization reactivity decreases with increasing molecular structure and complexity. While simple thiophenes represent the more labile sulfur types, the other extreme, sometimes referred to as "hard sulfur" or "refractory sulfur," is represented by the derivatives of dibenzothiophene, especially those mono- and di-substituted and condensed ring dibenzothiophenes bearing substituents on the carbons beta to the sulfur atom. These highly refractory sulfur heterocycles resist desulfurization as a consequence of steric inhibition precluding the requisite catalyst-substrate interaction. For this reason these materials survive traditional desulfurization and poison subsequent processes whose operability is dependent upon a sulfur sensitive catalyst. Destruction of these "hard sulfur" types can be accomplished under relatively severe process conditions, but this may prove to be economically undesirable owing to the onset of harmful side reactions leading to feed and/or product degradation. Also, the level of investment and operating costs required to drive the severe process conditions may be too great for the required sulfur specification.

A recent review (M. J. Girgis and B. C. Gates, *Ind. Eng. Chem.,*1991, 30, 2021) addresses the fate of various thiophenic types at reaction conditions employed industrially, e.g., 340–425° C. (644–799° F.), 825–2550 psig. For dibenzothiophenes the substitution of a methyl group into the 4-position or into the 4- and 6-positions decreases the desulfurization activity by an order of magnitude. These authors state, "These methyl-substituted dibenzothiophenes are now recognized as the organosulfur compounds that are most slowly converted in the HDS of heavy fossil fuels. One of the challenges for future technology is to find catalysts and processes to desulfurize them."

M. Houalla et al, *J Catal.,* 61, 523 (1980) disclose activity debits of 1–10 orders of magnitude for similarly substituted dibenzothiophenes under similar hydrodesulfurization conditions. While the literature addresses methyl substituted dibenzothiophenes, it is apparent that substitution with alkyl substituents greater than methyl, e.g., 4, 6-diethyldibenzothiophene, would intensify the refractory nature of these sulfur compounds. Condensed ring aromatic substituents incorporating the 3,4 and/or 6,7 carbons would exert a comparable negative influence. Similar results are described by Lamure-Meille et al, Applied Catalysis A: General, 131, 143, (1995) based on analogous substrates.

Mochida et al, Catalysis Today, 29, 185 (1996) address the deep desulfurization of diesel fuels from the perspective of process and catalyst designs aimed at the conversion of the refractory sulfur types, which "are hardly desulfurized in the conventional HDS process." These authors optimize their process to a product sulfur level of 0.016 wt. %, which reflects the inability of an idealized system to drive the conversion of the most resistant sulfur molecules to extinction. Vasudevan et al, Catalysis Reviews, 38, 161(1996) in a discussion of deep HDS catalysis report that while Pt and Ir catalysts were initially highly active on refractory sulfur species, both catalysts deactivated with time on oil.

In light of the above, there is a need for a desulfurization process capable of converting feeds bearing refractory, condensed ring sulfur heterocycles at relatively mild process conditions to products containing substantially no sulfur.

SUMMARY OF THE INVENTION

In accordance with the present invention there is provided a process for the substantially complete desulfurization of a stream selected from petroleum and chemical streams containing condensed ring sulfur heterocyclic compounds, which process comprises contacting said stream, at a temperature from about 40° C. to 500° C. and a pressure from about 100 to 3,000 psig, with a catalyst system comprised of: (a) a hydrodesulfurization catalyst comprised of a noble metal selected from the group consisting of Pt, Pd, Ir, Rh and polymetallics thereof, on an inorganic refractory support; and (b) a hydrogen sulfide sorbent material In a preferred embodiment of the present invention, the noble metal is selected from Pt, Pd, Ir, and polymetallics thereof.

In another preferred embodiment of the present invention the hydrodesulfurization catalyst and the hydrogen sulfide sorbent are present in a single mixed bed.

In still another preferred embodiment of the present invention said hydrogen sulfide sorbent flows through a bed of said noble metal catalyst with the feedstream.

In yet another preferred embodiment of the present invention the hydrogen sulfide sorbent material is selected from supported and unsupported metal oxides, spinels, zeolitic based materials, and layered double hydroxides.

DETAILED DESCRIPTION OF THE INVENTION

Feedstocks suitable for being treated by the present invention are those petroleum based feedstocks which contain condensed ring sulfur heterocyclic compounds, as well as other ring compounds, including multi-ring aromatic and naphthenic compounds. Such compounds are typically found in petroleum streams boiling in the distillate range and above. Non-limiting examples of such feeds include diesel fuels, jet fuels, heating oils, and lubes. Such feeds typically have a boiling range from about 150 to about 600° C., preferably from about 175 to about 400° C. It is preferred that the streams first be hydrotreated to reduce sulfur contents, preferably to less than about 500 wppm, more preferably to less than about 200 wppm, most preferably to less than about 100 wppm sulfur, ideally to less than about 50 wppm. It is highly desirable for the refiner to upgrade these types of feedstocks by removing as much of the sulfur as possible.

It is well known that so-called "easy" sulfur compounds, such as non-thiophenic sulfur compounds, thiophenes, benzothiophenes, and non-beta dibenzothiophenes can be removed without using severe process conditions. The prior art teaches that substantially more severe conditions are needed to remove the so-called "hard" sulfur compounds, such as condensed ring sulfur heterocyclic compounds which are typically present as 3-ring sulfur compounds, such as beta and di-beta dibenzothiophenes. An example of a typical three ring "hard" sulfur compound found in petroleum streams is 4,6-diethyldibenzothiophene. While the desulfurization process of the present invention is applicable to all sulfur bearing compounds common to petroleum and chemical streams, it is particularly suitable for the desulfurization of the least reactive, most highly refractory sulfur species, particularly the class derived from dibenzothiophenes, and most especially the alkyl, aryl, and condensed ring derivatives of this heterocyclic group, particularly those bearing one or more substituents in the 3-, 4-, 6-, and 7-positions relative to the thiophenic sulfur. The process of the present invention will result in a product stream with substantially no sulfur. For purposes of this invention, the term, "substantially no sulfur", depends upon the overall process being considered, but can be defined as a value less than about 1 wppm, preferably less than about 0.5 wppm, more preferably less than about 0.1 wppm, and most preferably less than about 0.01 wppm as measured by existing, conventional analytical technology.

Catalysts suitable for use in the present invention are those comprised of a noble metal selected from the group consisting of Pt, Pd, Ir, Rh and polymetallic compounds thereof on an inorganic refractory support. Preferred noble metals are Pt, Pd, Ir, and polymetallics thereof. The noble metal will be highly dispersed and substantially uniformly distributed on a refractory inorganic support. Various promoter metals may also be incorporated for purposes of selectivity, activity, and stability improvement. Non-limiting examples of such promoter that may be used herein include those selected from the group consisting of Re, Cu, Ag, Au, Sn, Zn, and the like.

Suitable support materials for the catalysts and hydrogen sulfide sorbents of the present invention include inorganic, refractory materials such as alumina, silica, silicon carbide, amorphous and crystalline silica-aluminas, silica-magnesias, aluminophosphates boria, titania, zirconia, and mixtures and cogels thereof. Preferred supports include alumina and the crystalline silica-aluminas, particularly those materials classified as clays or zeolites, and more preferably controlled acidity zeolites, including aluminophosphates, and modified by their manner of synthesis, by the incorporation of acidity moderators, and post-synthesis modifications such as demetallation and silylation. For purposes of this invention particularly desirable zeolitic materials are those crystalline materials having micropores and include conventional zeolitic materials and molecular sieves, including aluminophosphates and suitable derivatives thereof. Such materials also include pillared clays and layered double hydroxides.

The metals may be loaded onto these supports by conventional techniques known in the art. Such techniques include impregnation by incipient wetness, by adsorption from excess impregnating medium, and by ion exchange. The metal bearing catalysts of the present invention are typically dried, calcined, and reduced; the latter may either be conducted ex situ or in situ as preferred. The catalysts need not be presulfided because the presence of sulfur is not essential to hydrodesulfurization activity and activity maintenance. However, the sulfided form of the catalyst may be employed without harm and in some cases may be preferred if the absence of catalyst sulfur contributes to the loss of selectivity or to decreased stability. If sulfiding is desired, then it can be accomplished by exposure to dilute hydrogen sulfide in hydrogen or by exposure to a sulfur containing hydrocarbon feed until sulfur breakthrough is detected.

Total metal loading for catalysts of the present invention is in the range of about 0.01 to 5 wt. %, preferably about 0.1 to 2 wt. %, and more preferably about 0.15 to 1.5 wt. %. For bimetallic noble metal catalysts similar ranges are applicable to each component; however, the bimetallics may be either balanced or unbalanced where the loadings of the individual metals may either be equivalent, or the loading of one metal may be greater or less than that of its partner. The loading of stability and selectivity modifiers ranges from about 0.01 to 2 wt. %, preferably about 0.02 to 1.5 wt. %, and more preferably about 0.03 to 1.0 wt. Chloride levels range from about 0.3 to 2.0 wt. %, preferably about 0.5 to 1.5 wt. %, and more preferably about 0.6 to 1.2 wt. %. Sulfur loadings of the noble metal catalysts approximate those produced by breakthrough sulfiding of the catalyst and range from about 0.01 to 1.2 wt. %, preferably about 0.02 to 1.0 wt. %.

The hydrogen sulfide sorbent of this invention may be selected from several classes of material known to be reactive toward hydrogen sulfide and capable of binding same in either a reversible or irreversible manner. Metal oxides are useful in this capacity and may be employed as the bulk oxides or may be supported on an appropriate support material. Representative metal oxides include those of the metals from Groups IA, IIA, IB, IIB, IIIA, IVA, VB, VIB, VIIB, VIII of the Periodic Table of the Elements. Representative elements include Zn, Fe, Ni, Cu, Mo, Co, Mg, Mn, W, K, Na, Ca, Ba, La, V, Ta, Nb, Re, Zr, Cr, Ag, Sn, and the like. The metal oxides may be employed individually or in combination. The preferred metal oxides are those of Ba, K, Ca, Zn, Co, Ni, and Cu. Representative supported metal oxides include ZnO on alumina, CuO on silica, ZnO/CuO on kieselguhr, and the like. Compounds of the Group IA and IIA metals capable of functioning as hydrogen sulfide sorbents include, in addition to the oxides, the hydroxides, alkoxides, and sulfides. These systems are disclosed in the following patents of Baird et al. incorporated herein by reference: U.S. Pat. Nos. 4,003,823; 4,007,109; 4,087,348; 4,087,349; 4,119,528; 4,127,470.

Spinels represent another class of hydrogen sulfide sorbents useful in this invention. These materials are readily synthesized from the appropriate metal salt, frequently a sulfate, and sodium aluminate under the influence of a third agent like sulfuric acid. Spinels of the transition metals listed above may be utilized as effective, regenerable hydrogen sulfide sorbents; zinc aluminum spinel, as defined in U.S Pat. No. 4,263,020, incorporated herein by reference, is a preferred spinel for this invention. The sulfur capacity of spinels may be promoted through the addition of one or more additional metals such as Fe or Cu as outlined in U.S. Pat. No. 4,690,806, which is incorporated herein by reference.

Zeolitic materials may serve as hydrogen sulfide sorbents for this invention as detailed in U.S. Pat. Nos. 4,831,206 and -207, which is incorporated herein by reference. These materials share with spinels the ability to function as regenerable hydrogen sulfide sorbents and permit operation of this invention in a mode cycling between sulfur capture and sulfur release in either continuous or batch operation depending upon the process configuration. Zeolitic materials incorporating sulfur active metals by ion exchange are also of value to this invention. Examples include Zn4A, chabazite, and faujasite moderated by the incorporation of zinc phosphate, and transition metal framework substituted zeolites similar to, but not limited to, U.S. Pat. Nos. 5,185,135/6/7 and U.S. Pat. No. 5,283,047, and continuations thereof, all incorporated herein by reference.

Various derivatives of hydrotalcite (often referred to as LDH, layered double hydroxides) exhibit high sulfur capacities and for this reason serve as hydrogen sulfide sorbents for this invention. Specific examples include $Mg_{4.8}Al_{1.2}(OH)_{12}Cl_{1.2}$, $Zn_4Cr_2(OH)_{12}$ $Zn_4Al_2(OH)_{12}Cl_2$, $Mg_{4.5}Al_{1.5}(OH)_{12}C_{1.5}$, $Zn_4Fe_2(OH)_{12}Cl_2$, and $Mg_4Al_2(OH)_{12}Cl_3$ and may include numerous modified and unmodified synthetic and mineral analogs of these as described in U.S. Pat. Nos. 3,539,306, 3,796,792, 3,879,523, and U.S. Pat. No. 4,454,244, and reviewed by Cavani et al. in *Catalysis* Today, Vol. 11, No. 2, pp. 173–301 (1991), all of which are incorporated herein by reference. Particularly active hydrogen sulfide sorbents are LaRoach H–T, $ZnSi_2O_5$ gel, $Zn_4Fe_2(OH)_{12}Cl_2$, and the Fe containing clay, nontronite. A study of several Mg—Al hydrotalcites demonstrated a preference for crystallites less than about 300 Angstroms. Particularly novel are pillared varieties of smectites, kandites, LDHs and silicic acids in which the layered structure is pillared by oxides of Fe, Cr, Ni, Co, and Zn, or such oxides in combination with alumina as demonstrated by, but not limited to, U.S. Pat. Nos. 4,666,877, 5,326,734, 4,665,044/5 and Brindley et al, *Clays And Clay Minerals,* 26, 21 (1978) and *Amer. Mineral,* 64, 830 (1979), all incorporated herein by reference. The high molecular dispersions of the reactive metal make them very effective scavengers for sulfur bearing molecules.

A preferred class of hydrogen sulfide sorbents are those which are regenerable as contrasted to those which bind hydrogen sulfide irreversibly in a stoichiometric reaction. Hydrogen sulfide sorbents which bind hydrogen sulfide through physical adsorption are generally regenerable through manipulation of the process temperature, pressure, and/or gas rate so that the sorbent may cycle between adsorption and desorption stages. Representative of such sorbents are zeolitic materials, spinels, meso-. and microporous transition metal oxides, particularly oxides of the fourth period of the Periodic Chart of the Elements.

Hydrogen sulfide sorbents which bind hydrogen sulfide through a chemisorptive mechanism may also be regenerated by the use of reactive agents through which the hydrogen sulfide is reacted and restored to its initial, active state. Reagents useful for the regeneration of these types of hydrogen sulfide sorbents are air (oxygen), steam, hydrogen, and reducing agents such as carbon and carbon monoxide. The choice of regenerating agent is determined by the initial, active state of the sorbent and by the chemical intermediates arising during the regeneration procedure. Active hydrogen sulfide sorbents regenerable by reaction with oxygen include the oxides of manganese, lanthanum, vanadium, tantalum, niobium, molybdenum, rhenium, zirconium, chromium, and mixtures thereof. Active hydrogen sulfide sorbents regenerable through reaction with steam, either alone or in combination with oxygen, include the oxides of lanthanum, iron, tin, zirconium, titanium, chromium, and mixtures thereof. Active hydrogen sulfide sorbents regenerable through the sequential action of hydrogen and oxygen include the oxides of iron, cobalt, nickel, copper, silver, tin, rhenium, molybdenum, and mixtures thereof. Active hydrogen sulfide sorbents regenerable through the action of hydrogen include iron, cobalt, nickel, copper, silver, mercury, tin, and mixtures thereof. In addition all transition metal oxides are regenerable from their corresponding sulfates by reduction with hydrogen, carbon, or carbon monoxide. These regeneration reactions may be facilitated by the inclusion of a catalytic agent that facilitates the oxidation or reduction reaction required to restore the sulfur sorbent to its initial, active condition.

In addition, of particular interest as regenerable hydrogen sulfide sorbents are two classes of materials: zeolitic materials enriched in the alkali metals of Group IA; the high surface area, porous materials represented by zeolite-like structures, nonstoichiometric basic oxides of the transition metals, reviewed in part by Wadsley (Nonstoichiometric Compounds, edited by Mandelkom, Academic Press, 1964) and numerous surfactant templated metal oxide materials analogous to MCM-41 type structures as disclosed in U.S. Pat. No. 5,057,296 incorporated herein by reference.

These regeneration processes operate over a temperature range of 100–700° C., preferably 150–600° C., and more preferably 200–500° C. at pressures comparable to those cited below in the general disclosure of process conditions common to this invention.

The hydrodesulfurization catalyst and the hydrogen sulfide sorbent used in the practice of the present invention may be utilized in various bed configurations within the reactor. The choice of configuration may or may not be critical depending upon the objective of the overall process, particularly when the process of the present invention is integrated with one or more subsequent processes, or when the objective of the overall process is to favor the selectivity of one aspect of product quality relative to another. For example, bed configuration, catalyst formulation and/or process conditions can be varied to control the level of concomitant aromatics saturation. Mixed bed configurations tend to increase aromatics saturation relative to their stacked bed counterparts. Also, higher metal loading, higher pressure and/or lower space velocity can lead to increased levels of aromatics saturation.

The hydrodesulfurization catalyst and the hydrogen sulfide sorbent used in the practice of the present invention may be utilized in various bed configurations within the reactor. The choice of configuration may or may not be critical depending upon the objectives of the overall process, particularly when the process of the present invention is integrated with one or more subsequent processes, or when the objective of the overall process is to favor the selectivity of one aspect of product quality relative to another. Various bed configurations are disclosed with the understanding that the selection of a specific configuration is tied to these other process objectives. A bed configuration utilizing a common reactor where the hydrogen sulfide sorbent is placed upstream of the hydro-desulfurization catalyst is excluded. One bed configuration consists of a stacked bed wherein the hydrodesulfurization catalyst is stacked, or layered, above and upstream of the hydrogen sulfide sorbent. Stacked beds may either occupy a common reactor, or the hydrodesulfurization catalyst may occupy a separate reactor upstream of the reactor containing the hydrogen sulfide sorbent. This dedicated reactor sequence is preferred when it is desirable to operate the hydrodesulfurization catalyst and the hydrogen sulfide sorbent at substantially different reactor temperatures or to facilitate frequent or continuous replacement of the hydrogen sulfide sorbent material.

A second configuration is a mixed bed wherein particles of the hydrodesulfurization catalyst are intimately intermixed with those of the hydrogen sulfide sorbent. In both the stacked and mixed bed configurations, the two components may share similar or identical shapes and sizes, or the particles of one may differ in shape and/or size from the particles of the second component. The latter relationship is of potential value to the mixed bed configuration if it should be desirable to affect a simple physical separation of the bed components upon discharge or reworking. Additionally, the hydrogen sulfide sorbent material can be sized to allow sorbent particles to flow through a fixed bed of hydrodesulfurization catalyst moving with the liquid phase.

Materials can also be formulated which allow the HDS function and the hydrogen sulfide sorbent function to reside on a common particle. In one such formulation, the HDS and hydrogen sulfide sorbent components are blended together to form a composite particle. For example, a finely divided, powdered Pt on alumina catalyst is uniformly blended with zinc oxide powder and the mixture formed into a common catalyst particle, or zinc oxide powder is incorporated into the alumina mull mix prior to extrusion, and Pt is impregnated onto the zinc oxide-containing alumina in a manner similar to that described in U.S. Pat. No. 4,963,249, which is incorporated herein by reference.

Another formulation is based on the impregnation of a support with a HDS-active metal salt (e.g., Pt) and a hydrogen sulfide sorbent-active salt (e.g., Zn) to prepare a bimetallic catalyst incorporating the HDS metal and the hydrogen sulfide sorbent on a common base. For example, a Pt—Zn bimetallic may be prepared in such a manner as to distribute both metals uniformly throughout the extrudate, or, alternatively, the Zn component may be deposited preferentially in the exterior region of the extrudate to produce a rim, or eggshell, Zn rich zone, or the Pt component may be deposited preferentially in the exterior region of the extrudate to produce a rim, or eggshell, Pt rich zone. These are often referred to as "cherry" structures.

Three component guard bed configurations are also suitable for use herein, the choice of which is subject to the conditions previously disclosed for two component systems. One variation of the three-component bed is one that utilizes a mixed hydrodesulfurization catalyst/hydrogen sulfide sorbent bed upstream of a single hydrodesulfurization catalyst; this generic arrangement is identified as mixed/stacked. In the second variation, the stacked/stacked/stacked configuration, the three components are layered sequentially with a hydrodesulfurization catalyst occupying the top and bottom positions and the hydrogen sulfide sorbent the middle zone. While the three-component systems may occupy a common reactor, these systems may utilize a two reactor train where a hydrodesulfurization catalyst and a hydrogen sulfide sorbent in either a mixed or stacked configuration occupy the lead reactor and a hydrodesulfurization catalyst occupies the tail reactor. Another configuration is where a HDS catalyst occupies the lead reactor and a stacked hydrogen sulfide sorbent/HDS catalyst occupies the tail reactor. These arrangements permit operating the two reactor sections at different process conditions, especially temperature, and imparts flexibility in controlling process selectivity and/or product quality.

The composition of the sorbent bed is independent of configuration and may be varied with respect to the specific process, or integrated process, to which this invention is applied. In those instances where the capacity of the hydrogen sulfide sorbent is limiting, the composition of the sorbent bed must be consistent with the expected lifetime, or cycle, of the process. These parameters are in turn sensitive to the sulfur content of the feed being processed and to the degree of desulfurization desired. For these reasons, the composition of the guard bed is flexible and variable, and the optimal bed composition for one application may not serve an alternative application equally well. In general, the weight ratio of the hydrogen sulfide sorbent to the hydrodesulfurization catalyst may range from 0.01 to 1000, preferably from 0.5 to 40, and more preferably from 0.7 to 30. For three component configurations the ranges cited apply to the mixed zone of the mixed/stacked arrangement and to the first two zones of the stacked/stacked/stacked design. The hydrodesulfurization catalyst present in the final zone of these two configurations is generally present at a weight equal to, or less than, the combined weight compositions of the upstream zones.

The process of this invention is operable over a range of conditions consistent with the intended objectives in terms of product quality improvement and consistent with any downstream process with which this invention is combined in either a common or sequential reactor assembly. It is understood that hydrogen is an essential component of the process and may be supplied pure or admixed with other passive or inert gases as is frequently the case in a refining or chemical processing environment. It is preferred that the hydrogen stream be sulfur free, or substantially sulfur free, and it is understood that the latter condition may be achieved if desired by conventional technologies currently utilized for this purpose. In general, the conditions of temperature and pressure are significantly mild relative to conventional hydroprocessing technology, especially with regard to the processing of streams containing the refractory sulfur types as herein previously defined. This invention is commonly operated at a temperature of 40–500° C. (104–932° F.) and preferably 225–400° C. (437–752° F.). Operating pressure includes 100–3,000 psig, preferably 100–2,200 psig, and more preferably 100–1,000 psig at gas rates of 50–10,000 SCF/B (standard cubic feet per barrel), preferably 100–7, 500 SCF/B, and more preferably 500–5,000 SCF/B. The feed rate may be varied over the range 0.1–100 LHSV (liquid hourly space velocity), preferably 0.3–40 LHSV, and more preferably 0.5–30 LHSV.

The process of this invention may be utilized as a stand alone process for purposes of various fuels, lubes, and chemicals applications. Alternatively, the process may be combined and integrated with other processes in a manner so that the net process affords product and process advantages and improvements relative to the individual processes not combined. Potential opportunities for the application of the process of this invention follow; these illustrations are not intended to be limiting.

Process applications relating to fuels processes include: desulfurization of FCC streams preceding recycle to 2nd stage processing; desulfurization of hydrocracking feeds; multiring aromatic conversion through selective ring opening (U.S. Ser. Nos. 523,299; 523,300; 524,357; 524,358, filed Sep. 5, 1995 and incorporated herein by reference); aromatics saturation processes; sulfur removal from natural gas and condensate streams. Process applications relating to the manufacture of lubricants include: product quality improvement through mild finishing treatment; optimization of white oil processes by decreasing catalyst investment and/or extending service factor; pretreatment of feed to hydroisomerization, hydrodewaxing, and hydrocracking. Process applications relating to chemicals processes include: substitute for environmentally unfriendly nickel based hydroprocessing; preparation of high quality feedstocks for olefin manufacture through various cracking processes and for the production of oxygenates by oxyfunctionalization processes.

This invention is illustrated by, but not limited to, the following examples which are for illustrative purposes only.

EXAMPLES

Preparation of Feedstock A (Partially Saturated Cyclic Feedstock)

An aromatics solvent stream containing primarily $C_{11}$ and $C_{12}$ naphthalenes with an API gravity of 10.0 was hydrogenated over 90 g (125 cc) of a 0.5 wt. % Pd on alumina catalyst. The catalyst was prereduced in flowing hydrogen at 750° F. for 1 hour at atmospheric pressure. The aromatics solvent feedstock was passed over the catalyst at 265° F., an LHSV of 1 with a hydrogen treat gas rate of 6000 SCF/B. Pressure was initially set at 400 psig and increased throughout the run to compensate for catalyst deactivation to a final pressure of 700 psig. The product balances were blended together to give a partially saturated product with API gravity of 19.2.

Preparation of Feedstock B (Saturated Cyclic Feedstock)

An aromatics solvent stream containing primarily $C_{11}$ and $C_{12}$ naphthalenes with an API gravity of 10.0 was hydrogenated over 180 g (250 cc) of a 0.6 wt. % Pt on alumina catalyst. The catalyst was prereduced in flowing hydrogen at 750° F. for 16 hours at atmospheric pressure. The aromatics solvent feedstock was passed over the catalyst at 1800 psig, 550° F., an LHSV of 1 with a hydrogen treat gas rate of 7000 SCF/B. The saturated product had an API gravity of 31.6 and was analyzed to contain less than 0.1 wt. % aromatics and greater than 99 wt. % naphthenes.

Preparation of Feedstock C

Feedstock C was prepared by blending 62 wt. % of Feedstock B with 38 wt. % of Feedstock A and spiking to 47 wppm S with 4,6-diethyldibenzothiophene. The feedstock had an API gravity of 23.7 and contained 53 wt. % aromatics as measured by supercritical fluid chromatography (SFC).

Example 1

A reactor was charged with a mixed bed of 0.62 g of a catalyst comprised of 0.3 wt. % Pt on gamma alumina and 7.5 g of a ZnO. The catalyst system was reduced at atmospheric pressure at 300° C. for 18.5 hr. with 50 cc/min. of hydrogen flow. This catalyst system was used to process Feedstock C. The product gravity, aromatics content and sulfur level were measured to follow catalyst activity at various space velocities. The results are presented in Table 1.

TABLE 1

Processing of Feedstock C at 300° C., 650 psig, and 5000 SCF/B $H_2$

| Example | Catalyst | LHSV (over Pt) | API Gravity | Wt.% Aromatics | Sulfur, wppm |
|---|---|---|---|---|---|
| 1 | Pt + ZnO | 2 | 26.5 | 33.7 | <1 |
| 1 | Pt + ZnO | 10 | 24.3 | 50.5 | 18 |
| 2 | Pt/ZnO | 1 | 25 | 45.3 | 10 |
| 2 | Pt/ZnO | 3.5 | 24.1 | 51.0 | 18 |
| 2 | Pt/ZnO | 10 | 24.0 | 53.0 | 33 |

Example 2

A reactor was charged with a stacked bed of 0.62 g of a 0.3 wt. % Pt catalyst followed by 5.72 g of a ZnO. The catalyst system was reduced at atmospheric pressure at 300° C. for 18.5 hr. with 50 cc/min. of hydrogen flow The catalyst was used to process Feedstock C. The product gravity, aromatics content and sulfur level were measured to follow catalyst activity at various space velocities. The results are presented in Table 1 and illustrate lower activity of the stacked bed system for HDS as compared to the mixed bed catalyst system of Example 1. When the catalyst systems of Examples 1 and 2 are compared at 10 LHSV, the product sulfur level from the mixed bed is almost two times lower than that from the stacked bed. To reach a product sulfur level of 18 wppm, the LHSV over the stacked bed is approximately three times lower than that required by the mixed bed. The mixed bed produces a product with <1 wppm S at an LHSV of 2 mixed bed produces a product with 10 wppm S at an LHSV of 1.

Example 3

A reactor was charged with 3.49 g. of a $NiMo/Al_2O_3$ sulfided catalyst. The catalyst was sulfided with 10% $H_2S/H_2$ at 75 cc/min. flow at 100° C. for 2 hr., 200° C. for 2 hr. and held overnight at 375° C. The catalyst system was used to process feedstock D which is composed of 6,303 g. of Feedstock A and 280 g. of Feedstock B with 163 ppm of sulfur as 4,6-diethyldibenzothiophene was added. The product sulfur level and the process conditions are shown in Table 2 below.

Example 4

Example 3 was repeated except the reactor was charged with a mixed bed of 2.46 g of a catalyst comprised of 0.6 wt. % Pt on gamma alumina and 39.6 g of ZnO. The catalyst was reduced with 100% hydrogen at 50 cc/min. at 100° C. for 2 hr., 200° C. for 2 hr. and held overnight at 375° C. The sulfur level of the product is shown in Table 2 below.

TABLE 2

Processing of Feedstock D at 325° C., 300 psig, 1000 SCF/B $H_2$, and 3 LHSV

| Example | Product Sulfur Level, wppm |
|---|---|
| 3 | 99 |
| 4 | 24 |

The results in Table 2 show that at mild hydroprocessing conditions a mixed bed of Pt on alumina catalyst and ZnO is significantly more active than conventional sulfided NiMo hydrotreating for sulfur removal.

Example 5

A reactor was charged with mixed bed of 2.9 g of a 0.6 wt. % Pt/alumina catalyst and 1.7 g of a zinc oxide. This catalyst system was used to process a hydrotreated light cat cycle oil with API gravity of 27.1 containing 60 wppm sulfur, 1 wppm nitrogen and 56 wt. % aromatics. The product gravity, aromatics content and sulfur level were measured. The results presented in Table 3 indicate that HDS and aromatics saturation reactions are occurring simultaneously.

Example 6

A reactor was charged with mixed bed of 0.6 g of a 0.3 wt. % Pt/alumina reforming catalyst and 7.7 g of a zinc oxide. This catalyst system was used to process the feed of Example 11. The product gravity, aromatics content and sulfur level were measured at various space velocities. The results presented in Table 3 indicate that HDS can be largely decoupled from aromatics saturation by choice of catalyst, bed configuration and process conditions.

TABLE 3

Processing of LCCO Containing 60 wppm S, 1 wppm N and 56 wt.% Aromatics 650 psig and 5000 SCF/B $H_2$

| Example | Catalyst | Temp., ° C. | LHSV (over Pt) | API Gravity | Wt.% Aromatics | Sulfur, wppm |
|---|---|---|---|---|---|---|
| 5 | 0.6 Pt + ZnO | 315 | 0.75 | 32.8 | 3.4 | <1 |
| 6 | 0.3 Pt + ZnO | 300 | 9.9 | 27.4 | 47.7 | <1 |
| 6 | 0.3 Pt + ZnO | 300 | 22.3 | 27.3 | 48.7 | <1 |

What is claimed is:

1. A process for the substantially complete desulfurization of distillate streams containing condensed ring sulfur heterocyclic compounds, which process comprises contacting said stream with a catalyst system comprised of: (a) a hydrodesulfurization catalyst comprised of a noble metal selected from the group consisting of Pt, Pd, Ir, Rh, and polymetallics thereof, on an inorganic refractory support; and (b) a hydrogen sulfide sorbent material; wherein the hydrodesulfurization conditions include temperatures from about 40° C. to 500° C., and pressures from about 100 to 3,000 psig, wherein both the catalyst and the hydrogen sulfide sorbent material are present on the same composite particles.

2. The process of claim 1 wherein the level of sulfur in the feedstream is less than about 500 wppm.

3. The process of claim 2 wherein the noble metal is selected from Pt, Pd, Ir, and polymetallics thereof.

4. The process of claim 3 wherein the hydrodesulfurization catalyst and the hydrogen sulfide sorbent are present in a single mixed bed.

5. The process of claim 2 wherein the hydrogen sulfide sorbent material is selected from supported and unsupported metal oxides, spinels, zeolitic based materials, and hydrotalcites.

6. The process of claim 2 wherein the hydrodesulfurization catalyst is promoted with one or more metals selected from the group consisting of Re, Cu, Ag, Au, Sn, Mn, and Zn.

7. The process of claim 2 wherein the concentration of noble metal is from about 0.01 to 3 wt. %, based on the total weight of the catalyst.

8. The process of claim 2 wherein the inorganic refractory support is selected from the group consisting of oxides of Al, Si, Mg, B, Ti, Zr, P, and mixtures and cogels thereof.

9. The process of claim 3 wherein the inorganic refractory support is selected from clays and zeolitic materials and mixtures thereof.

10. The process of claim 9 where the zeolite is enriched with one or more metals of Group Ia of the Periodic Table of the Elements.

11. The process of claim 2 wherein the hydrogen sulfide sorbent is a metal oxide of metals from Groups IA, IIA, IB, IIB, IIIA, IVA, VB, VIB, VIIB, and VIII of the Periodic Table of the Elements.

12. The process of claim 11 wherein the metal is selected from the group consisting of K, Ba, Ca, Zn, Co, Ni, and Cu.

13. The process of claim 3 wherein the hydrodesulfurization metal and the metal of the hydrogen sulfide sorbent are precipitated on the same support material.

14. The process of claim 2 wherein the pressure is from about 100 to 1,000 psig.

15. The process of claim 3 wherein the pressure is from about 100 to 1,000 psig.

* * * * *